US006257925B1

(12) United States Patent
Jones

(10) Patent No.: US 6,257,925 B1
(45) Date of Patent: Jul. 10, 2001

(54) PAIR OF CONNECTORS CLAMPING A PRINTED CIRCUIT BOARD

(75) Inventor: Dennis B. Jones, Orange, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/610,240

(22) Filed: Jul. 5, 2000

(51) Int. Cl.[7] ..... H01R 13/60
(52) U.S. Cl. ..... 439/557; 439/357
(58) Field of Search ..... 439/353, 357, 439/533, 554, 555, 557, 569, 571, 953

(56) References Cited

U.S. PATENT DOCUMENTS 3,523,269 * 8/1970 Witer, Jr. et al. ..... 439/557
3,573,716 * 4/1971 Garver ..... 439/353
3,790,923 * 2/1974 Mathe ..... 439/557
5,525,074 * 6/1996 Tsuji et al. ..... 439/555
5,823,812 * 10/1998 Bhargava et al. ..... 439/345
6,089,909 * 7/2000 Tokuwa ..... 439/557
6,146,210 * 11/2000 Cha et al. ..... 439/680

* cited by examiner

*Primary Examiner*—Khiem Nguyen
*Assistant Examiner*—Thanh-Tam Le
(74) *Attorney, Agent, or Firm*—Wei Te Chung

(57) ABSTRACT

A connector assembly comprises a first connector and a second connector, with a printed circuit board located therebetween. The first connector comprises a first mating housing and a socket integrally connected to the first mating housing. The second connector comprises a second mating housing, a first board lock and a second board lock integrally connected to the second mating housing. The printed circuit board defines a first hole, a second hole and a third hole in such locations respectively corresponding to the locations of the second mating housing, the second board lock, and the first board lock. The second connector is fixed to the printed circuit board and the first connector by engaging the first board lock with the third hole of the printed circuit board, rendering the second mating housing of the second connector to be engaged with the first mating housing of the first connector, rendering the second board lock to extend through the second hole and finally to be retained in the socket of the first connector.

13 Claims, 5 Drawing Sheets

PAIR OF CONNECTORS CLAMPING A PRINTED CIRCUIT BOARD

BACKGROUND OF THE INVENTION

1. Field of the Invention

The present invention relates to a pair of connectors connected associated with a printed circuit board, particularly to a pair of connectors firmly located at opposite sides with respect to the printed circuit board and one of the connectors has board locks fixed to the printed circuit board.

2. The Prior Art

Electrical connectors are used popularly for interconnection between two electrical devices which may be mother boards, hard disk drivers or the like. The interconnection configurations of the connectors and the electrical devices may be different according to respective structural requirements of electrical systems. When a first connector is mounted on a printed circuit board, a second connector may be added on the first connector if only the two connectors are matingly adapted to each other. However, this kind of connection is not strong and stable enough, therefore this connection is apt to be loosened during transportation.

It is requisite to provide a new connector assembly which can guarantee stable interconnection between the connectors and the printed circuit board during transportation.

SUMMARY OF THE INVENTION

The primary purpose of the present invention is to provide a pair of connectors one of which is firmly fixed on a printed circuit board while the other of which is firmly fixed on the previous one connector.

One aspect of the present invention is to provide a connector assembly comprising a first connector and a second connector, with a printed circuit board located therebetween.

The first connector comprises a first housing having a cavity defined therein and two sockets formed at two ends of the first housing. The second connector comprises a second housing having a mating face and two side portions integrally connected to the second housing, each side portion having a first board lock and a second board lock extending upright.

The printed circuit board defines a first hole, two second holes symmetric to the first hole, and two third holes symmetric to the first hole. The second connector is fixed to the printed circuit board, wherein the first board lock is engaged with the third hole of the printed circuit board, the second housing of the second connector is retained in place by the first hole of the printed circuit board and a portion thereof extends beyond the printed circuit board. The second connector is fixed to the first connector, with the portion of the second housing of the second connector which extends beyond the printed circuit board is received in the cavity of the first connector and the second board lock is engaged within the socket of the first connector.

Another aspect of the present invention is to provide a connector assembly comprising a first connector and a second connector, with a printed circuit board located therebetween. The first connector comprises a first mating housing and a socket integrally connected to the first mating housing. The second connector comprises a second mating housing, a first board lock and a second board lock integrally connected to the second mating housing. The printed circuit board defines a first hole, a second hole and a third hole in such locations respectively corresponding to the locations of the second mating housing, the second board lock, and the first board lock. The second connector is fixed to the printed circuit board and the first connector by engaging the first board lock with the third hole of the printed circuit board, rendering the second mating housing of the second connector to be engaged with the first mating housing of the first connector, rendering the second board lock to extend through the second hole and finally to be retained in the socket of the first connector.

DETAILED DESCRIPTION OF THE PREFERRED EMBODIMENT

Figure 1:
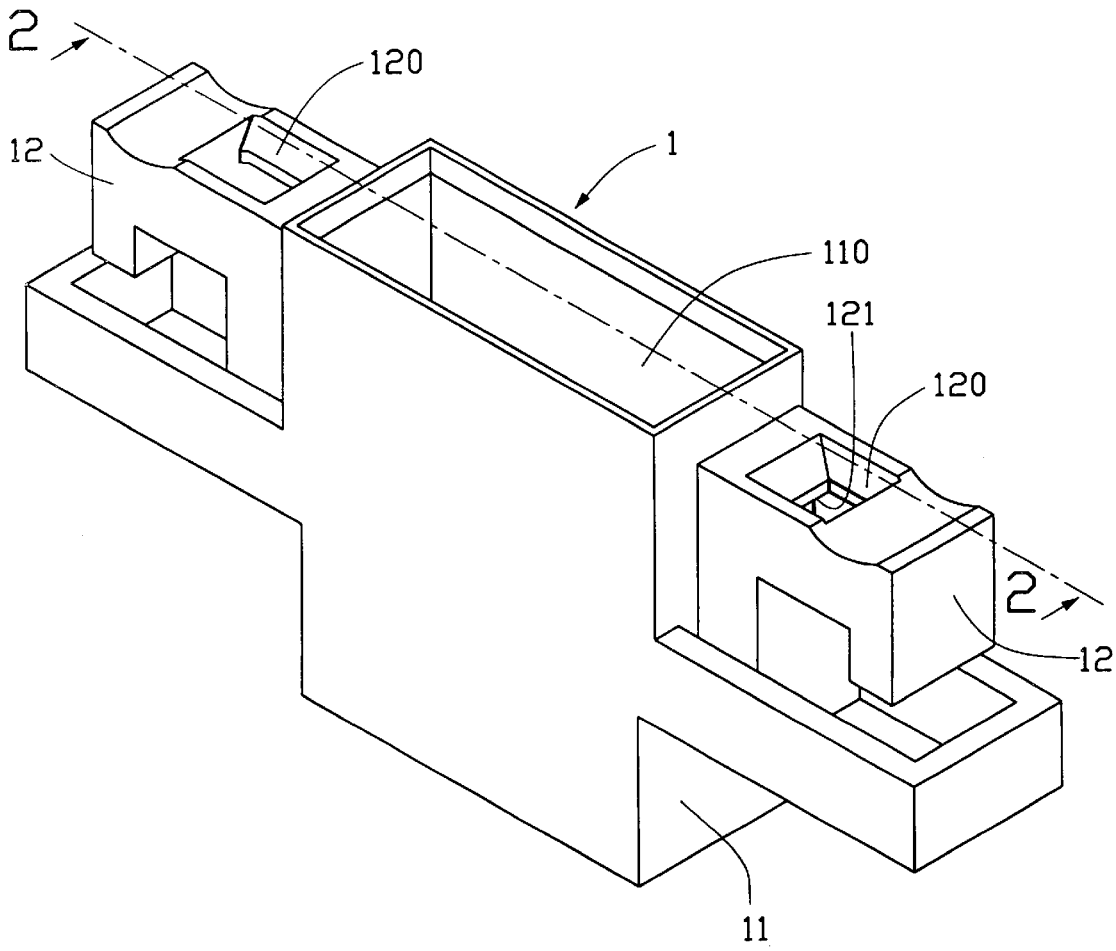
FIG. 1 is a perspective view of a first connector in accordance with the present invention.
Figure 2:
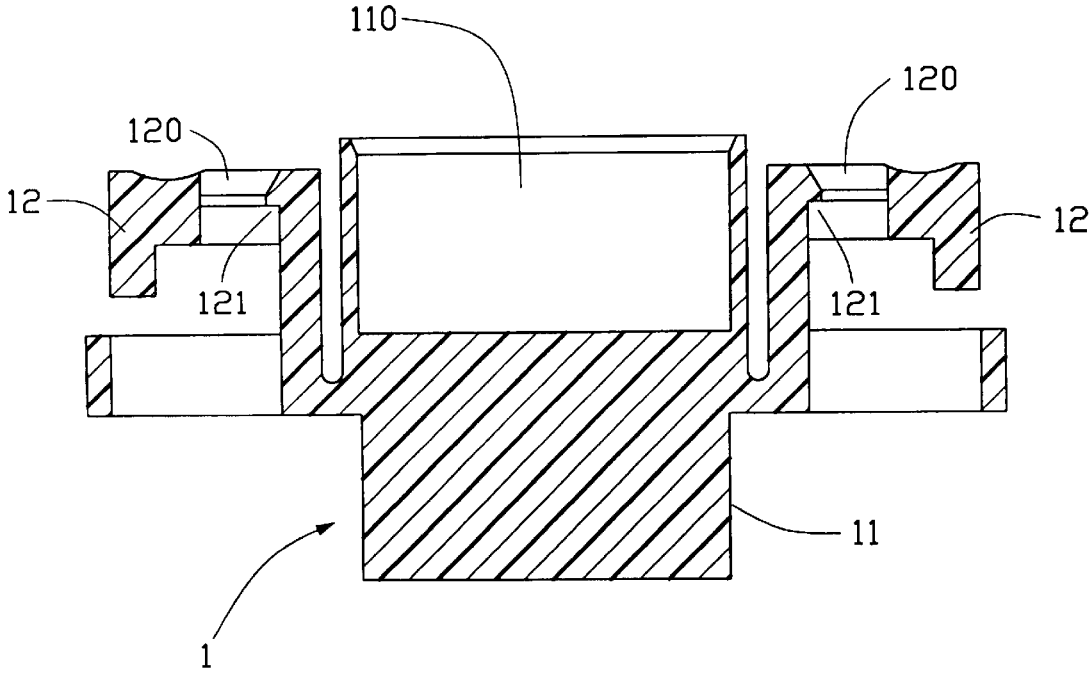
FIG. 2 is a cross-sectional view of the first connector of FIG. 1.

Referring to FIGS. 1 and 2, a first connector 1 in accordance with the present invention comprises a housing 11 having a mating portion (not labeled) defining a cavity 110 defined therein and two sockets 12 formed at two ends of the housing 11. Each socket 12 is spaced from the mating portion of the housing 11 with a gap (not labeled) therebetween for allowing transverse deflection of the socket 12. Each socket 12 has a tapered hole 120 defined therein and a positioning step 121 formed in an inner periphery of the tapered hole 120.

Figure 3:
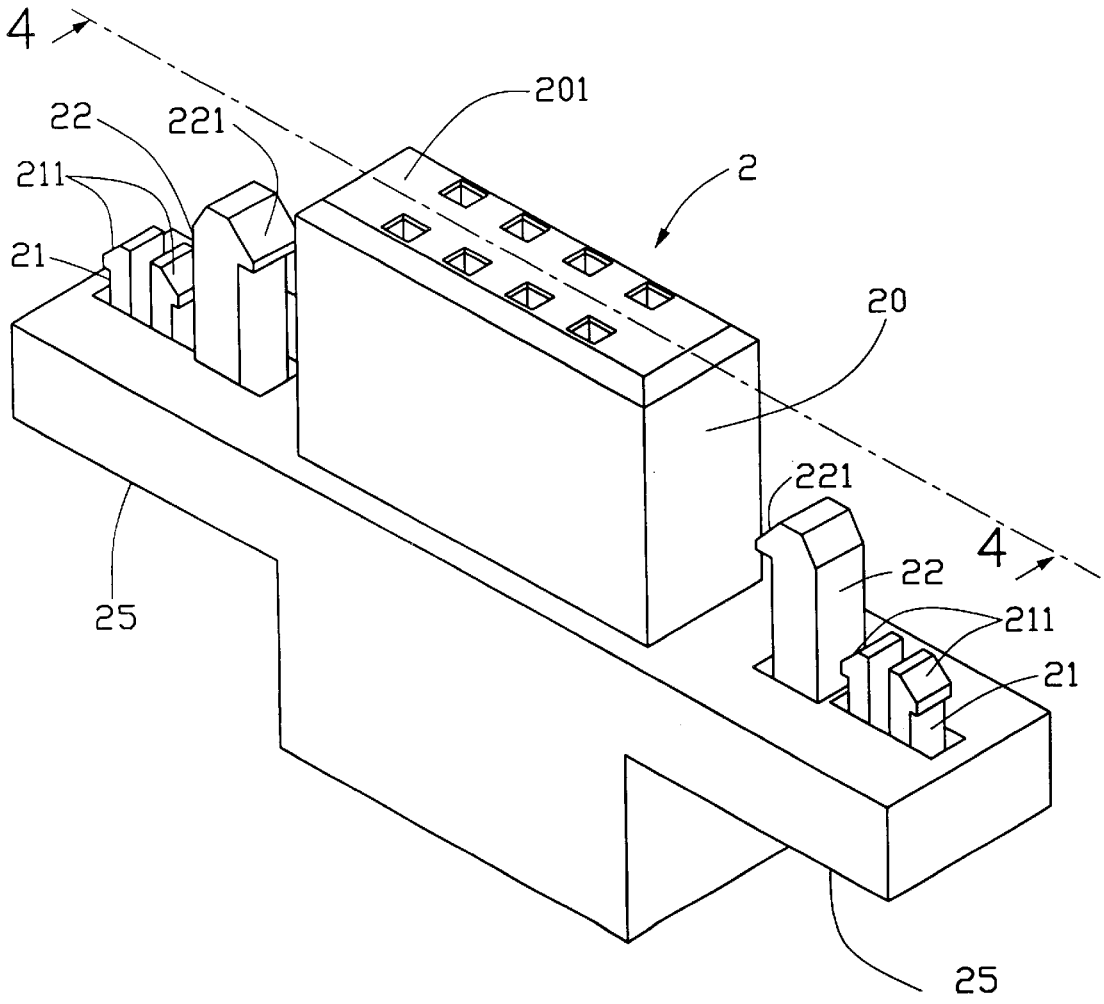
FIG. 3 is a perspective view of a second connector in accordance with the present invention.
Figure 4:
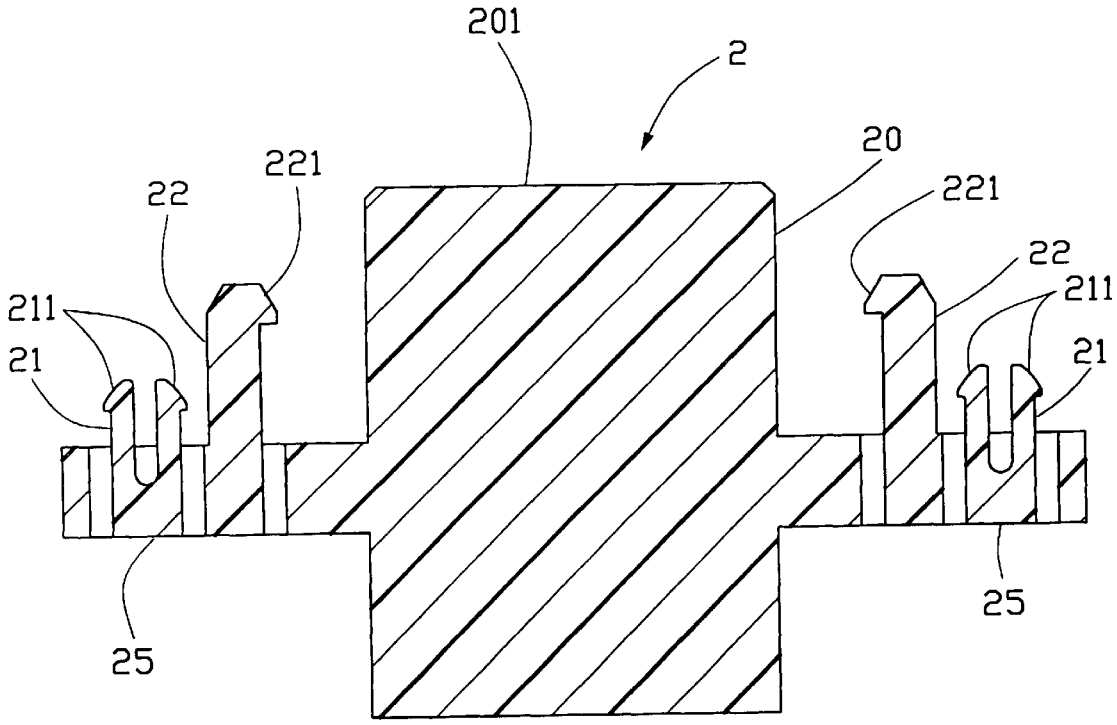
FIG. 4 is a cross-sectional view of the first connector of FIG. 1.

Referring to FIGS. 3 and 4, a second connector 2 in accordance with the present invention comprises a housing 20 having a mating face 201 and two side portions 25 integrally connected to the housing 20. Each side portion 25 has a first board lock 21 and a second board lock 22 extending upright. The first board lock 21 has two hooks 211 while the second board lock 22 has a single hook 221, wherein the hook 221 of the second board lock 22 is higher than the hook 211 of the first board lock 21.

Figure 5:
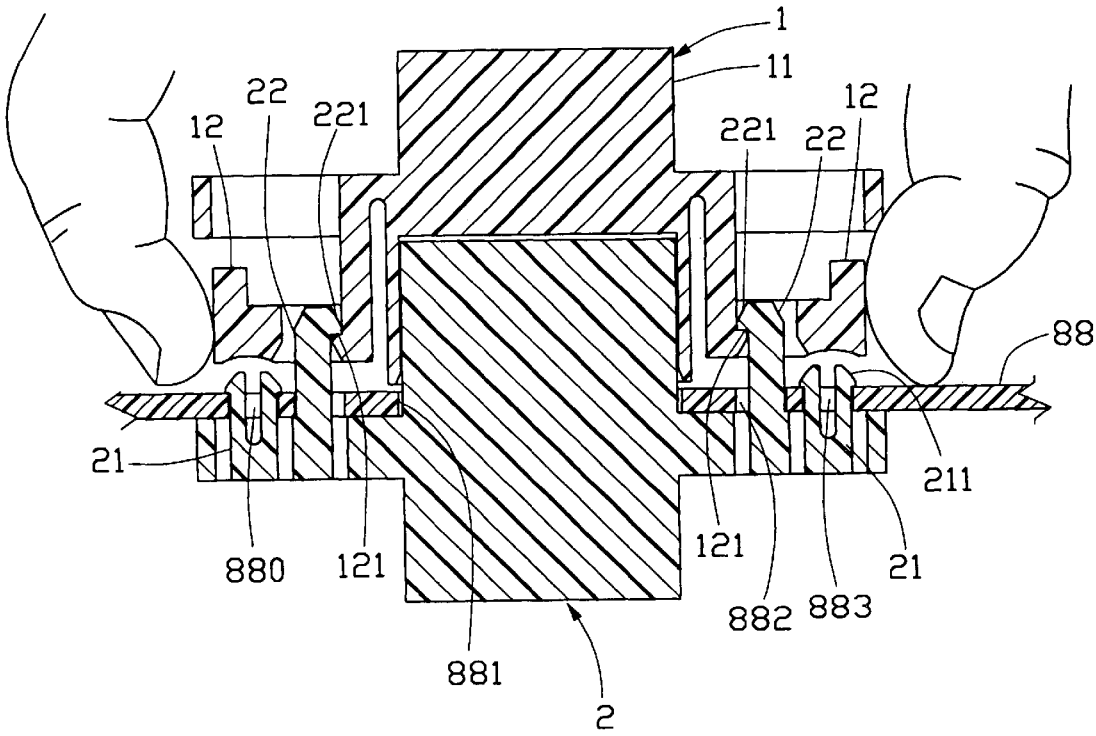
FIG. 5 is a schematic view showing connection between the first connector, the printed circuit board, and the second connector.

Referring to FIG. 5, a printed circuit board 88 is provided for interconnection with the second connector 2. The printed circuit board 88 has a first hole 881, two second holes 882, and two third holes 883 defined therein. The two second holes 882 are symmetric to the first hole 881, and the two third holes are also symmetric to the first hole 881. The second connector 2 is fixed to the printed circuit board 88 by engaging the first board lock 21 with the third hole 883 of the printed circuit board 88. The housing 20 of the second connector 2 has a portion retained in place by the first hole 881 of the printed circuit board 88 when the first board lock 21 is engaged with the third hole 883.

After the second connector 2 is engaged with the printed circuit board 88, the first connector 1 is then operated to engage with the second connector 2. A portion of the housing 20 of the second connector 2 which extends beyond the printed circuit board 88 is received in the cavity 110 of the first connector 1 and the second board lock 22 is engaged within the tapered hole 120 of the socket 12. Specifically, the hook 221 of the second board lock 22 abuts against the positioning step 121 formed in the inner periphery of the tapered hole 120 of the socket 12. Accordingly, the first connector 1 and the second connector 2 are engaged to each other and the printed circuit board 88 is firmly fixed to the second connector 2.

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. A connector assembly comprising a first connector and a second connector, with a printed circuit board located therebetween;

the first connector comprising a first housing having a cavity defined therein and two sockets formed at two ends of the first housing;

the second connector comprising a second housing having a mating face and two side portions integrally connected to the second housing, each side portion having a first board lock and a second board lock extending upright;

the printed circuit board defining a first hole, two second holes symmetric to the first hole, and two third holes symmetric to the first hole;

wherein the second connector is fixed to the printed circuit board by engaging the first board lock with the third hole of the printed circuit board, the second housing of the second connector being retained in place by the first hole of the printed circuit board and having a portion extending beyond the printed circuit board; and wherein the second connector is fixed to the first connector, with a portion of the second housing of the second connector which extends beyond the printed circuit board is received in the cavity of the first connector and the second board lock is engaged within the socket of the first connector.

2. The connector assembly as claimed in claim 1, wherein the first board lock has two first hooks and the second board lock has a second hook.

3. The connector assembly as claimed in claim 2, wherein the first hook of the first board lock is shorter than the second hook of the second board lock.

4. The connector assembly as claimed in claim 3, wherein the socket of the first connector has a tapered hole defined therein and a positioning step formed in an inner periphery of the tapered hole for engagement with the second hook of the second board lock.

5. A connector assembly comprising a first connector and a second connector, with a printed circuit board located therebetween;

the first connector comprising a first mating housing and a socket connected to the first mating housing;

the second connector comprising a second mating housing, a first board lock and a second board lock integrally connected to the second mating housing;

the printed circuit board defining a first hole, a second hole and a third hole in such locations respectively corresponding to the locations of the second mating housing, the second board lock, and the first board lock;

wherein the second connector is fixed to the printed circuit board and the first connector by engaging the first board lock with the third hole of the printed circuit board, rendering the second mating housing of the second connector to be engaged with the first mating housing of the first connector, rendering the second board lock to extend through the second hole and to be retained in the socket of the first connector.

6. The connector assembly as claimed in claim 5, wherein the first board lock has two first hooks and the second board lock has a second hook.

7. The connector assembly as claimed in claim 6, wherein the first hook of the first board lock is shorter than the second hook of the second board lock.

8. The connector assembly as claimed in claim 7, wherein the socket of the first connector has a tapered hole defined therein and a positioning step formed in an inner periphery of the tapered hole for engagement with the second hook of the second board lock.

9. A connector assembly comprising:

a printed circuit board defining first, second and third holes therethrough in a direction perpendicular to said printed circuit board;

a first connector mounted on one side of said printed circuit board, said first connector including a first housing, a board lock and a locking device all extending along said direction;

said housing extending through said first hole, said locking device extending through said second hole, and said board lock retainably extending through the third hole for holding the first connector to said printed circuit board.

10. The assembly as claimed in claim 9, further including a second connector positioned on the other side of said printed circuit board.

11. The assembly as claimed in claim 10, wherein said second connector includes a second housing receiving said first housing.

12. The assembly as claimed in claim 10, wherein said second connector includes a socket latchably engaged with the locking device.

13. The assembly as claimed in claim 12, wherein said socket is transversely deflectable to release the locking device.

* * * * *